US007707959B2

(12) United States Patent
Miura et al.

(10) Patent No.: US 7,707,959 B2
(45) Date of Patent: May 4, 2010

(54) BOAT WITH SPONSON

(75) Inventors: Takayoshi Miura, Saitama (JP); Takao Kochi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 105 days.

(21) Appl. No.: 11/371,098

(22) Filed: Mar. 9, 2006

(65) Prior Publication Data

US 2006/0201408 A1 Sep. 14, 2006

(30) Foreign Application Priority Data

Mar. 11, 2005 (JP) ..... 2005-069161

(51) Int. Cl.
*B63B 17/00* (2006.01)
*B63B 35/73* (2006.01)
*B63B 3/00* (2006.01)
*B63B 17/02* (2006.01)

(52) U.S. Cl. ..... 114/363; 114/55.5; 114/343; 114/355; 114/361

(58) Field of Classification Search ..... 114/55.5, 114/343, 355–357, 361, 364
See application file for complete search history.

(56) References Cited

U.S. PATENT DOCUMENTS 4,627,373 A * 12/1986 Nishida ..... 114/182
6,210,242 B1 * 4/2001 Howard et al. ..... 440/21
6,776,114 B2 * 8/2004 Abe ..... 114/88
6,883,455 B2 * 4/2005 Maeda et al. ..... 114/357
2004/0129192 A1 * 7/2004 Guerard ..... 114/61.33

FOREIGN PATENT DOCUMENTS

JP 2003-137188 A 5/2003

* cited by examiner

*Primary Examiner*—Daniel V Venne
(74) *Attorney, Agent, or Firm*—Birch, Stewart, Kolasch & Birch, LLP

(57) ABSTRACT

A small boat with a sponson for preventing splashing of spray onto the deck of the boat. The small boat is provided with a hull sponson at an outer periphery of the hull in order to fit the deck constituting an upper part of a boat body to the hull constituting a lower part of the boat body. A deck sponson is provided at an outer periphery of the deck, and the deck sponson is overlaid so as to bond with the hull sponson. The extent of projection of one member of the hull sponson and the deck sponson at the front section of the boat body is larger than the extent of projection of a member of the hull sponson and the deck sponson at a second member of the boat body. As a result, when the small boat is gliding and collides with a wave, the sponson prevents spray from the wave from splashing onto the deck.

19 Claims, 5 Drawing Sheets

FIG. 5
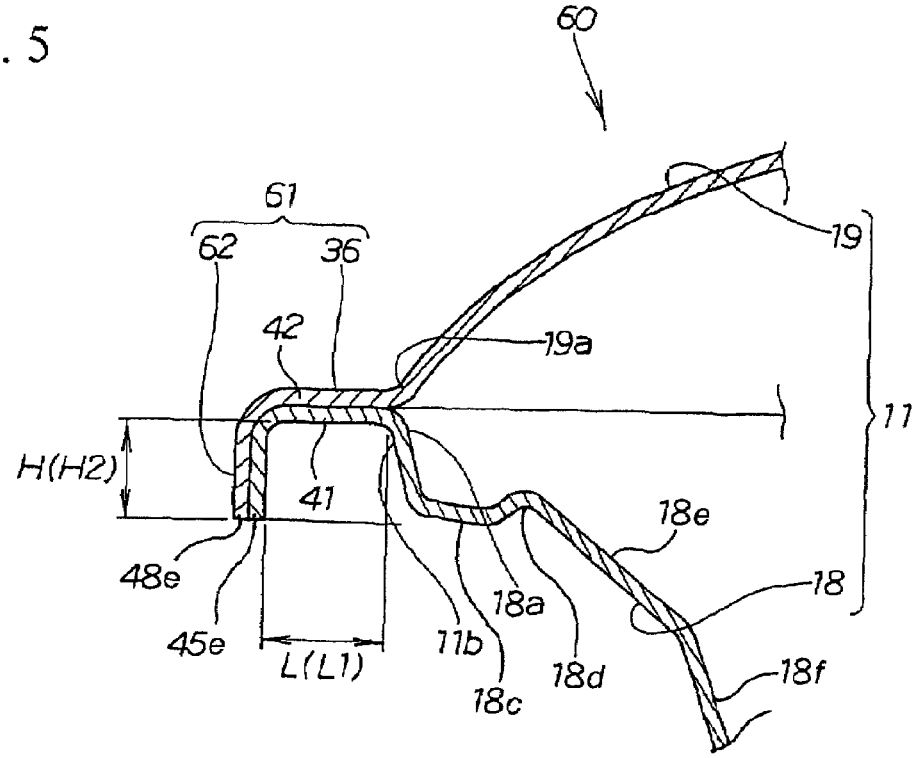
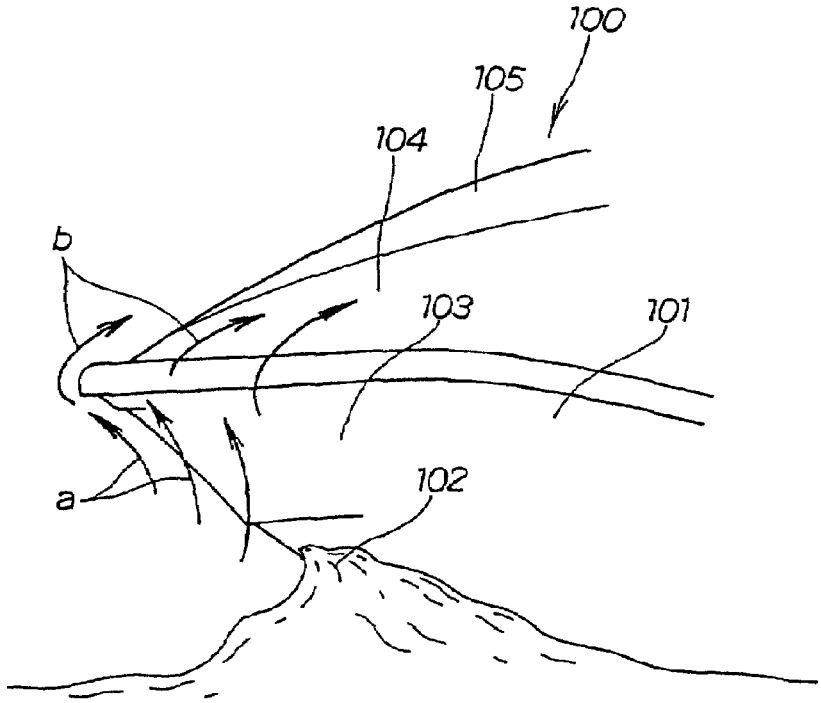
FIG. 6 Background Art

BOAT WITH SPONSON

CROSS-REFERENCE TO RELATED APPLICATION

The present application claims priority under 35 U.S.C. §119 to Japanese Patent Application No. 2005-069161, filed Mar. 11, 2005, the entire contents of which are hereby incorporated by reference.

BACKGROUND OF THE INVENTION

1. Field of the Invention

The present invention relates to a boat provided with a sponson section at the outer periphery of the hull, and a sponson section at the outer periphery of the deck, with the respective sponson sections bonded together to form a boat body.

2. Description of Background Art

Small boats exist where a water jet pump is fitted to a rear part of a boat body, with water then being sucked in from the boat bottom as a result of an engine driving a water jet pump, and the sucked-in water then being blasted to the rear so as to cause the small boat to glide.

The small-type boat is equipped with a front hood at an upper end of the deck with a gap formed between the front hood and the deck. Air from this gap is then taken in to within the boat body, and the air that is taken in is guided through the engine (for example, refer to Japanese Patent Laid-Open Publication No 2003-137188.

Here, it is necessary to ensure a gap for gathering air between the front hood and the deck, and there is the fear that sea water or water may permeate through this gap. Here, the small boat of Japanese Patent Laid-Open Publication No 2003-137188 has a labyrinth structure for the gap between the front hood and the deck. By adopting a labyrinth structure for the gap between the front hood and the deck, it is possible to only extract air from the gap and prevent sea water and water from permeating.

FIG. 6 is a view illustrating a gliding state of a small boat of the related art. An end 101*a* of the boat body 101 collides with a wave 102 so as to generate spray when the small boat 100 is gliding.

The large amount of spray generated then rises along the hull 103 as shown by arrow a. It can be considered that the rising spray will pass over the hull 103 so as to splash the side of the deck 104 as shown by the arrow b.

Even in the event that the spray splashes the side of the deck 104, it is necessary to prevent the spray from permeating to within the boat body 101 using the labyrinth structure between the deck 104 and front ford 105. Because of this, even in cases where the end 101*a* of the boat body 101 collides with the wave 102 so as to generate spray, it is preferable that the spray created does not splash the side of the deck 104.

SUMMARY AND OBJECTS OF THE INVENTION

It is therefore the object of the present invention to provide a small boat capable of preventing splashing of spray to the deck side.

According to a first aspect of the present invention, a small boat is provided with a hull sponson at an outer periphery of a hull in order to attach a deck constituting an upper part of a boat body to the hull constituting a lower part of the boat body, and a deck sponson provided at an outer periphery of the deck, with the deck sponson being overlaid on the hull sponson and bonded. Spray generated as a result of the boat body colliding with waves is prevented from splashing the deck side while the boat is gliding by making an extent of projection of a member on the side of the front section of the boat body larger than another member.

The extent of projection of the member on the side of the front section of the boat body, of the hull sponson and the deck sponson, is made larger than for other parts. It is also possible for spray generated as a result of the end of the boat body colliding with waves to collide with the hull sponson for which the extent of projection is larger and the deck sponson. As a result, it is possible to prevent spray from splashing the deck side by utilizing existing hull sponsons and deck sponsons.

According to a second aspect of the present invention, a small boat is provided with a hull sponson at an outer periphery of a hull in order to attach a deck constituting an upper part of a boat body to the hull constituting a lower part of the boat body, and a deck sponson provided at an outer periphery of the deck. The deck sponson is overlaid on the hull sponson and bonded. The hull sponson and deck sponson are formed with a substantially L-shaped cross-section using a horizontal sponson and a downwardly extending section. Thus it is possible to prevent spray generated as a result of the boat body colliding with waves splash the deck side while the boat body is gliding by making the height of the portion on the side of the front section of the boat body, of the downwardly extending section of the hull sponson and the deck sponson, larger than another member.

It is also possible to ensure that spray falls downwards in a substantially more reliable manner using a downwardly extending section by making the height of the member on the side of the end of the boat body, of the downwardly extending section of the hull sponson and deck sponson, larger than the other member. As a result, it is possible to reliably prevent the spray from splashing at the side of the deck.

According to the first aspect of the present invention, it is possible to prevent spray from splashing onto the side of the deck by making the extent of projection of the member on the side of the end of the boat body, of the hull sponson and the deck sponson, larger than the other member.

According to the second aspect of the present invention, it is possible to reliably prevent spray from splashing onto the side of the deck by making the height of the member on the side of the end of the boat body, of the downwardly extending section of the hull sponson and the deck sponson, larger than the other member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 5 is a cross-sectional view showing the essential parts of a small boat (of a second embodiment) of the present invention; and FIG. 6 is a view illustrating a gliding state of a small boat of the related art.

DETAILED DESCRIPTION OF THE PREFERRED EMBODIMENTS

The following is a description of preferred embodiments based on the appended drawings. Here, "front", "rear", "left" and "right" are such that Fr is the front side, Rr is the rear side, L is the left side, and R is the right side.

Figure 1:
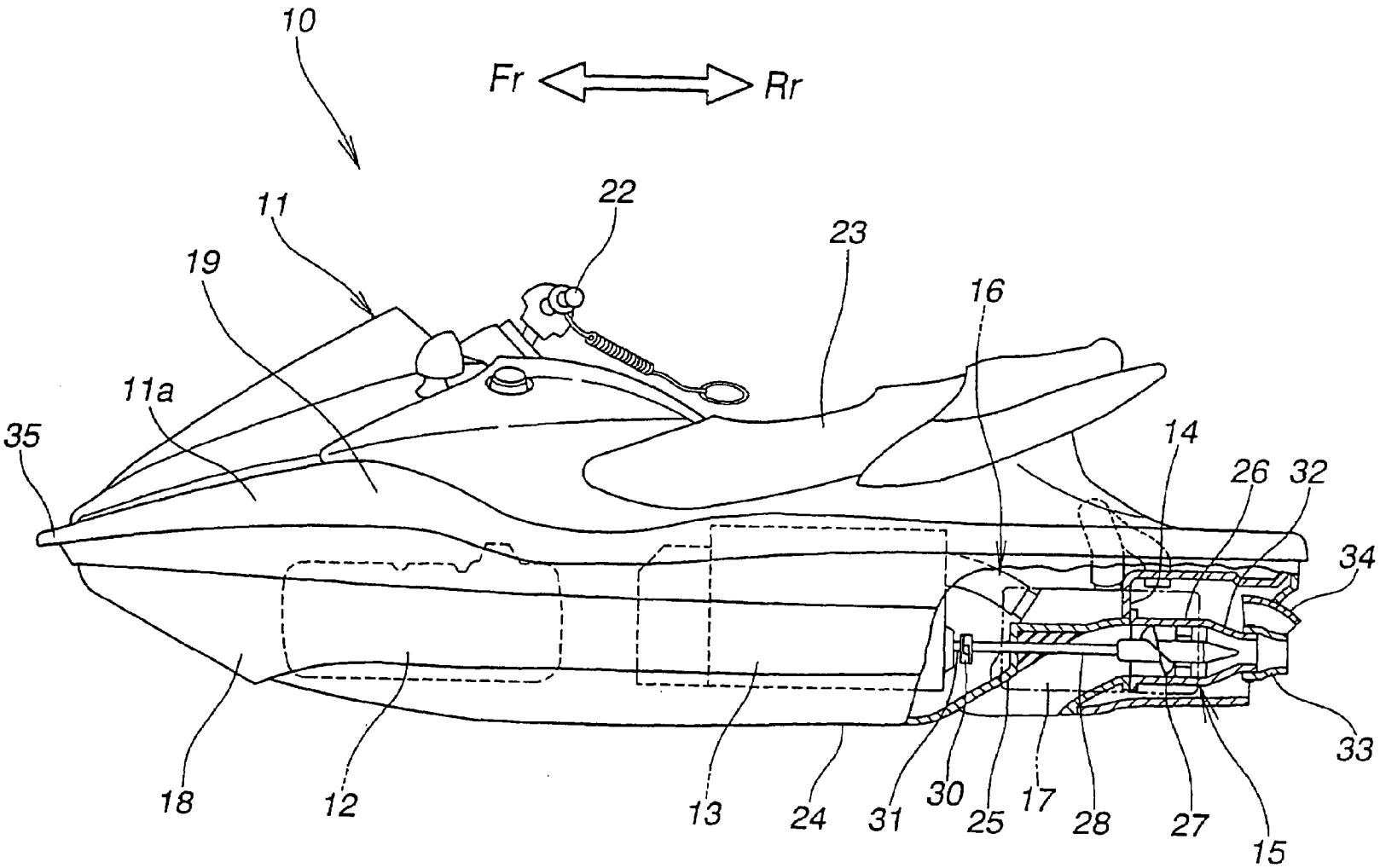
FIG. 1 is a side view of a small boat (first embodiment) of the present invention.

FIG. 1 is a side view of a small boat (first embodiment) of the present invention. A water jet propulsion boat is a small boat 10 equipped with a fuel tank 12 at a front section 11*a* of a boat body 11, an engine 13 is provided to the rear of this fuel tank 12, a pump chamber 14 is provided to the rear of the engine 13, a pump chamber 14 is provided to the rear of the engine 13, a water jet pump 15 is provided at this pump chamber 14, a water muffler 17 is fitted at the intake side of the exhaust pipe 16 at the engine 13 so that the exhaust side of an exhaust pipe 16 faces the inside of the pump chamber 14, at the middle of the exhaust pipe 16, handlebars 22 are fitted above the fuel tank 12, and a sheet 23 is fitted to the rear of the handlebars 22.

A hull 18 constituting the lower part of the boat body 11 is covered by a deck 19 constituting the upper part of the boat 11. A spray guard 35 is formed by utilizing a connection section connecting the deck 19 to the hull 18.

The water jet pump 15 is such that a housing 26 extends from an intake opening 25 of a boat bottom 24 to the rear, an impeller is fitted in a freely rotatable manner within the housing 26, and a propeller shaft 28 is provided at the impeller 27. The propeller shaft 28 is coupled to the drive shaft 31 of the engine 13 via the coupling joint 30.

According to the water jet pump 15, as a result of the impeller 27 rotating due to being driven by the engine 13, water taken in from the intake opening 25 of the boat bottom 24 is blasted to the rear of the boat body 11 from a steering nozzle (steering nozzle) 33 via a rear nozzle 32 of the housing 26. As a result, the small boat 10 is propelled (glides) in an advancing direction.

When the small boat 10 advances to the rear, a reverse bucket 34 above the steering nozzle 33 moves to a position of advancement to the rear to the rear of the steering nozzle 33. As a result, water spurted to the rear from the steering nozzle 33 is guided to the front of the boat body 11 by the reverse bucket 34, and the small boat 10 is made to advance rearwards by the guided spurting water.

Figure 2:
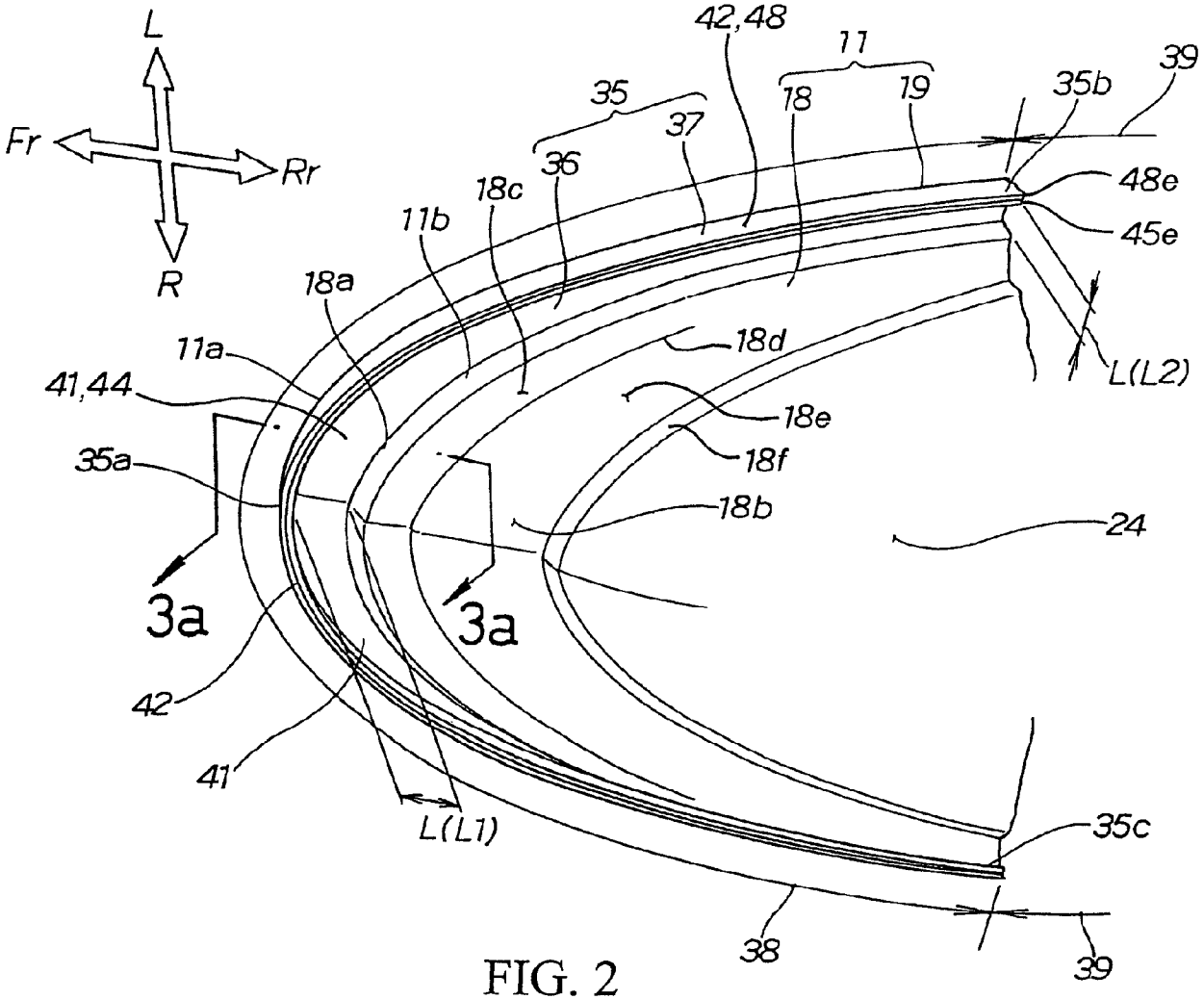
FIG. 2 is a perspective view showing the state of the small boat of a first embodiment when viewed from below.

FIG. 2 is a perspective view of a forward end 18*b* of the hull 18 showing the state of the small boat of a first embodiment when viewed from below. The spray guard 35 is formed along an outer periphery 11*b* of the boat body 11. The spray guard 35 has a spray receiving section 36 formed along the outer periphery 11*b* of the boat body 11 and has a spray returning section 37 extending in a downward direction from an end of the spray receiving section 36. As can be seen in FIG. 2, 3(*a*), and 3(*b*), hull 18 is formed with several distinct shapes between the hull sponson 41 and the hull bottom 24, including a first portion (upper end outer periphery) 18*a* extending substantially vertically and downwardly from a inner edge of the hull sponson 41, a second portion 18*c* extending substantially horizontally and inwardly with respect to a lower end of the upper end outer periphery, a downwardly facing concave groove 18*d* formed inwardly with respect to the second portion 18*c*, and first and second downward sloping portions 18*e*, 18*f* extending downwardly and inwardly from an inner side of the concave groove 18*d*, the second downward sloping portion 18*f* joining the hull bottom 24.

The spray guard 35 results from the deck sponson 42 being overlapped with the hull sponson 41 from above. The hull sponson 41 is a member projecting to outside along the upper end outer periphery (outer periphery) 18*a* of the hull 18. The deck sponson 42 is a member projecting to the outside along the outside (outer periphery) 19*a* (refer to FIGS. 3(*a*) and 3(*b*)) of the lower end of the deck 19. In the following, a detailed description is given of the spray guard 35.

Figure 3A:
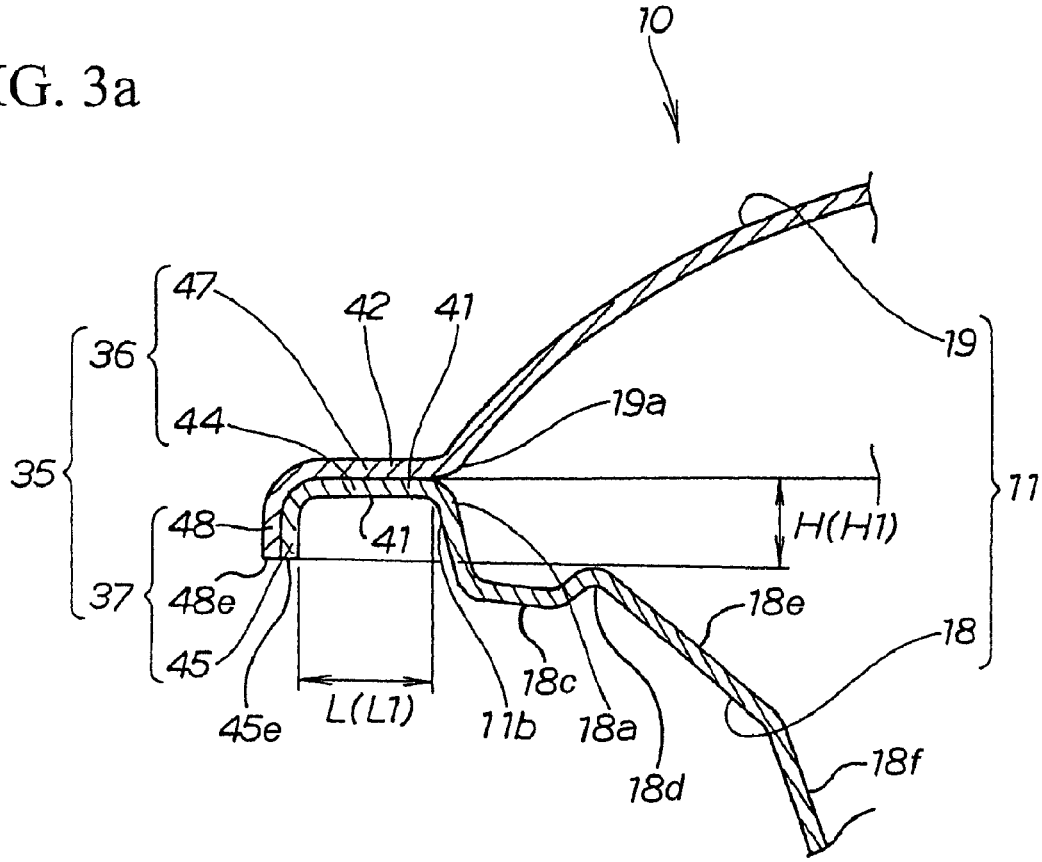
FIG. 3(*a*) is a cross-sectional view along 3*a*-3*a* of FIG. 2, and FIG. 3(*b*) is a cross-sectional view showing the essential parts of the small boat of the first embodiment in an exploded state.
Figure 3B:
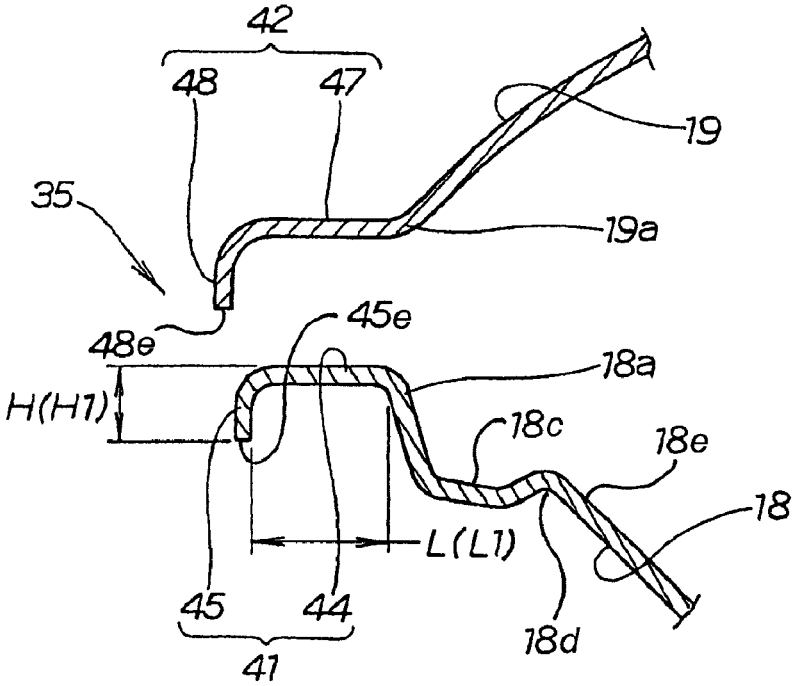

FIG. 3(*a*) is a cross-sectional view along 3*a*-3*a* of FIG. 2, and FIG. 3(*b*) is a cross-sectional view showing the essential parts of the small boat of the first embodiment in an exploded state. The hull sponson 41 is formed with a substantially L-shaped cross-section by a horizontal sponson 44 and a downwardly extending section 45. The horizontal sponson 44 projects substantially horizontally from the outer periphery 18*a* of the upper part of the hull 18 in a direction to outside. The extent of projection of the horizontal sponson 44 is L. The downwardly extending section 45 extends in a state of bending downwards from the outer end of the horizontal sponson 44. Height H of the downwardly extending section 45 is H1. In addition, FIGS. 3(*a*), 3(*b*), and 5 illustrate the second portion 81*c* of hull 18 that is substantially horizontal and extends rearwardly and inwardly toward a central portion of the boat from a lower end of the upper end outer periphery 18*a* of the hull 18.

The deck sponson 42 is formed with a substantially L-shaped cross-section by a horizontal sponson 47 and a downwardly extending section 48. The horizontal sponson 47 extends in a substantially parallel manner with respect to the horizontal sponson 44 from the outer periphery 19*a* of the lower part of the deck 19. The downwardly extending section 48 extends downwards in a direction parallel to the downwardly extending section 45 from the outer end of the horizontal sponson 47.

The deck sponson 42 is formed to be substantially round and large with respect to the hull sponson 41. As a result, it is possible to overlap the hull sponson 41 with the deck sponson 42 from above.

The deck sponson 42 is overlaid so as to cover the parallel sponson 41. The lower surface of the horizontal sponson 47 is bonded to the upper surface of the horizontal sponson 44 using adhesive (not shown), and the inner surface of the downwardly extending section 48 is bonded to the outer surface of the downwardly extending section 45 using adhesive (not shown). The deck sponson 42 is bonded to the hull sponson 41, so that the boat body 11 is formed from the hull 18 and deck 19.

Further, the deck sponson 42 is bonded to the hull sponson 41 so as to form the spray guard 35 from the hull sponson 41 and the deck sponson 42. The spray guard 35 is such that the spray receiving section 36 is formed along the outer periphery 11*b* of the boat body 11 from the horizontal sponsons 44, 47 and the spray returning section 37 is formed from the downwardly extending sections 45, 48. The spray receiving section 36 projects by the amount L and the spray returning section 37 has a height H of H1. Also, FIGS. 2, 3(*a*), 3(*b*), and 4(*b*)

illustrate lower edge 45*e* of downwardly extending section 45 of the hull sponson 41 being flush with lower edge 48*e* of downwardly extending section 48 of the deck sponson 42.

At an end 35*a*, the spray guard 35 is such that the end of the spray receiving section 36 projects substantially from the outer periphery 11*b* as a result of making the extent of projection L of the spray receiving section 36 large at L1.

Returning to FIG. 2, a description is given of the extent of projection L of the spray guard 35. The spray guard 35 is formed in such a manner that the extent of projection L of the end 35*a* is formed to a maximum L1, with the extent of projection L gradually becoming smaller from the end 35*a* to left and right portions 35*b*, 35*c* so as to become L2, and with the extent of projection L to the rear of the left and right portions 35*b*, 35*c* being formed so as to be fixed at L2.

As a result, the spray guard 35 is formed in such a manner that the extent of projection L of a member (i.e. member 38 on the side of the front section 11*a* of the boat body 11) from the end 35*a* to the left and right portions 35*b*, 35*c* is larger than other members 39.

Here, the dimensions of the extent of projection L2 of the other member 39, of the spray guard 35 and the dimensions of the height H1 (refer to FIG. 3) of the spray guard 35 are decided based on the bonding strength demanded by the hull 18 and the deck 19.

The reason the extent of projection L of the member 38 on the side of the front section 11*a* of the boat body 11 is formed so as to be large is as described below. Namely, the end (end section of the boat body) of the hull 18 collides with waves so as to create spray while the small boat 10 is gliding. The spray is therefore dispersed upwards by forming the extent of projection L of the member 38 of the front section 11*a* of the boat body 11 to be large, i.e. spray to the deck side is effectively suppressed.

In the above description, the extent of projection of the member 38 on the side of the front section 11*a* of the boat body 11 of the hull sponson 41 and the deck sponson 42 is formed to be large. Thus, it is possible to form the extent of projection L of the portion 38 of the front section 11*a* of the boat body 11 of the spray guard 35 to be large. As a result, spray generated as a result of the end 18*b* of the hull 18 colliding with the water when the boat body 11 is gliding is capable of colliding with the spray guard 35.

As a result, it is possible to utilize the hull sponson 41 and the deck sponson 42 as a spray guard 35 simply by making the extent of projection L of the member 38 on the side of the front section 11*a* of the boat body 11 of the existing hull sponson and deck sponson large. It is therefore possible to prevent spray from splashing to the side of the deck 19 by providing the spray guard 35.

Figure 4A:
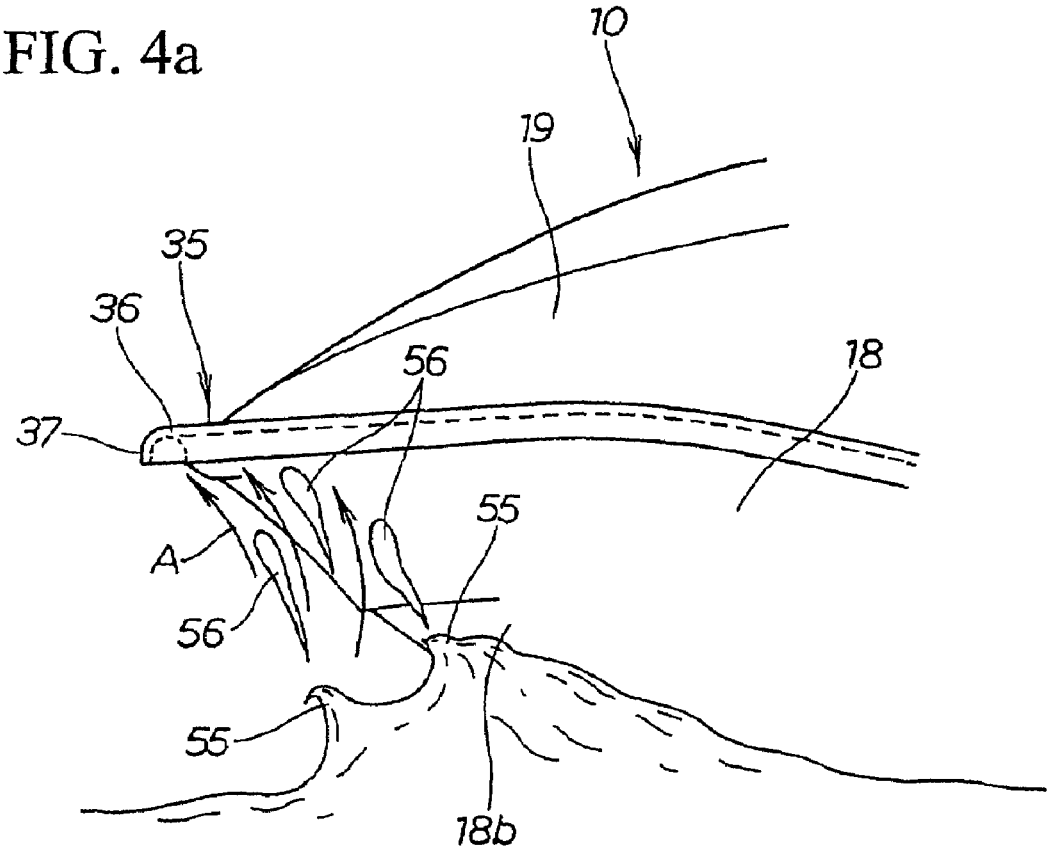
FIGS. 4(*a*) and 4(*b*) are views describing examples of guarding the small boat from spray of the first embodiment.
Figure 4B:
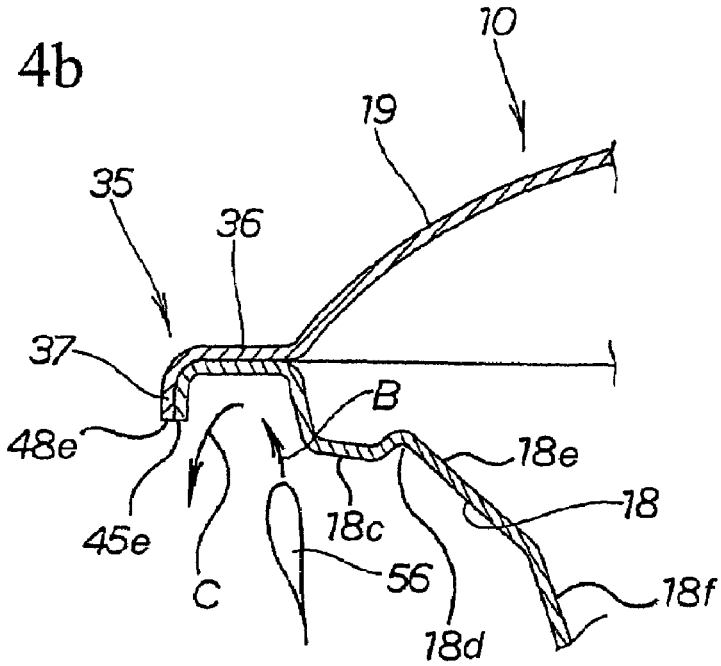

Next, a description is given of the operation of the spray guard 35 based on FIGS. 4 (*a*) and 4(*b*). FIG. 4(*a*) and FIG. 4(*b*) are views describing examples of guarding the small boat from spray of the first embodiment. In FIG. 4(*a*), an end 18*b* of the hull 18 collides with a wave 55 so as to generate spray 56. The large amount of spray 56 generated then rises along the hull 18 as shown by arrow A.

In FIG. 4(*b*), the spray 56 rises as shown by arrow B along the hull 18. The rising spray 56 collides with the spray receiving section 36 of the spray guard 35. Spray 56 colliding with the spray receiving section 36 then collides with the spray returning section 37, and falls downwards as shown by arrow C. As a result, it is possible to prevent the spray 56 from splashing at the side of the deck 19.

Next, a description is given of a second embodiment. In the second embodiment, portions that are the same or analogous to those of the small boat 19 in the first embodiment are given the same numerals and are not described. FIG. 5 is a cross-sectional view showing the essential parts of a small boat (of a second embodiment) of the present invention. With a small boat 60 of the second embodiment, the spray guard 35 of the first embodiment is replaced with a spray guard 61, with other aspects of the configuration being the same as for the first embodiment. The spray guard 61 is such that the spray returning section 62 is given a height H of H2 that is higher than the height H1 of the first embodiment.

Specifically, the spray guard 61 is such that the height H of an end 61*a* is formed to a maximum H2, with the height H from the end 61*a* to the left and right portions (i.e. portions corresponding to the left and right portions 35*b*, 35*c* of the first embodiment) gradually becoming smaller so as to become a height H1 (refer to FIG. 3), and with the height H to the rear of the left and right portions being fixed at H1. FIG. 5 also illustrates lower edge 45*e* of downwardly extending section 45 of the hull sponson 41 being flush with lower edge 48*e* of downwardly extending section 48 of the deck sponson 42.

As a result, the spray guard 61 is formed in such a manner that the height H of a member (i.e. member 38 on the side of the front section 11*a* of the boat body 11) from the end 61*a* to the left and right portions is larger than other members 39. The member 38 of the front section 11*a* of the boat body 11 and another member 39 are shown in FIG. 2.

According to the spray guard 61 of the second embodiment, by making the height H of the spray returning section 62 large at the member 38 on the side of the front section 11*a* of the boat body 11, it is possible for spray 56 colliding with the spray receiving section 36 to be made to fall downwards in a substantially more reliable manner using the spray returning section 37. It is therefore possible to more reliably prevent the spray 56 from splashing at the side of the deck 19.

As a result, it is possible to utilize an existing hull sponson and the deck sponson as a spray guard 61 simply by making the extent of projection L and height H of the member 38 on the side of the front section 11*a* of the boat body 11 of the existing hull sponson and deck sponson large.

In the second embodiment, an example is shown of the spray guard 61 where the extent of projection L of the member 38 on the side of the front section 11*a* of the boat 11 is formed so as to be larger than the other member 39. Further, the height H of the member 38 on the side of the front section 11*a* of the boat 11 is formed to be larger than the other member 39. However, the same results can also be obtained by forming the extent of projection L along the whole of the spray guard fixed at L2 (refer to FIG. 2), and forming only the height H of the member 38 on the side of the front section 11*a* of the boat body 11 larger than the other member 39. It is also possible for this form of spray guard to reliably prevent spray 56 from splashing to the side of the deck 19 similarly to the second embodiment.

Further, in this embodiment, a description is given of an example where splashing of spray 56 to the side of the deck 19 is prevented by making the extent of projection L and height H of the member 38 on the side of the front section 11*a* of the boat 11 of an existing hull sponson and deck sponson large but in addition to this embodiment, it is also possible to provide a plate for preventing splashing of spray to the side of the deck at the outer periphery of the front section 11*a* of the boat body 11.

The present invention is appropriate for application in a small boat provided with a sponson section at the outer periphery of the hull, and a sponson section at the outer periphery of the deck, with the respective sponson sections bonded together to form a boat body.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A boat with a sponson, comprising:

a hull sponson provided at an upper end outer periphery of a hull in order to attach a deck constituting an upper part of a boat body to the hull constituting a lower part of the boat body; and a deck sponson provided at an outer periphery of the deck, wherein the deck sponson is overlaid on the hull sponson and bonded, and wherein spray generated as a result of a front section of the boat body colliding with waves is prevented from splashing a deck side while the boat is gliding by making an extent of a projection of a member on the front section of the boat body equal to amount (L1), and by making the extent of the projection of another member at left and right lateral side portions of the boat body equal to amount (L2), wherein the amount (L1) is substantially larger than the amount (L2) in order to reduce the spray at the front section of the boat body, wherein each of the hull sponson and the deck sponson is formed with a downwardly extending section, and wherein a maximum height (H2) of the downwardly extending section at a front section of the hull sponson is larger than height (H1) of the downwardly extending section at left and right lateral side portions of the hull sponson disposed rearwardly of the front section of the hull sponson, the height (H) gradually becoming smaller in a rearward direction from the maximum height (H2) at the front section of the hull sponson so as to have the height (H1) at the left and right lateral side portions of the hull sponson.

2. The boat with a sponson according to claim 1, wherein the hull sponson includes a spray receiving section formed along the upper end outer periphery of the hull, and a spray returning section extending in a downward direction from an end of the spray receiving section.

3. The boat with a sponson according to claim 1, wherein the extent of the projection of the member gradually becoming smaller from a forward-most part of the front section where the extent is the amount (L1) to forward-most parts of left and right portions at a rear section of the boat body where the extent of the projection is the amount (L2), and wherein the extent of the projection at the left and the right portions at the rear section of the boat body being fixed at the amount (L2).

4. The boat with a sponson according to claim 1, wherein each of the hull sponson and the deck sponson is formed with a horizontal sponson and a downwardly extending section.

5. The boat with a sponson according to claim 1, wherein each of the hull sponson and the deck sponson is formed with a horizontal sponson and a downward extending section, wherein at least at the front section of the boat body, width of the amount (L1) of the horizontal sponson of the hull sponson is larger than a height (H1) of the downwardly extending section of the hull sponson.

6. The boat with a sponson according to claim 1, wherein each of the hull sponson and the deck sponson is formed with a downwardly extending section, wherein a height (H1) of the downwardly extending section is constant around the upper end outer periphery of the hull.

7. The boat with a sponson according to claim 1, wherein the hull sponson joins the portion of the upper end outer periphery of the hull that extends substantially vertically downward, the hull sponson and the upper end outer periphery of the hull that extends substantially downward forming a downwardly facing concave space around the upper end outer periphery of the hull.

8. The boat with a sponson according to claim 1, wherein a lower edge of the downwardly extending section of the hull sponson is flush with a lower edge of the downwardly extending section of the deck sponson.

9. The boat with a sponson according to claim 1, wherein the deck sponson is configured to overlap the hull sponson from above and to form a spray guard extending along the outer periphery of the hull of the boat, and in a direction extending rearwardly from a front of the boat and along left and right sides of the boat, the spray guard can be seen to be non-linear in shape when viewed in side elevation view, and the spray guard being configured to slant slightly upwardly with respect to horizontal between the front of the boat and positions above a central part of a fuel tank of the boat, and the spray guard being configured to curve and then to slant slightly downwardly with respect to a horizontal from positions above the central part of the fuel tank to a rear of the fuel tank of the boat.

10. The boat with a sponson according to claim 1, wherein the hull is formed with multiple distinct shapes between the hull sponson and a hull bottom, the multiple distinct shapes including:

the upper end outer periphery (a first portion) extending substantially vertically and downwardly from a inner edge of the hull sponson, a second portion extending substantially horizontally and inwardly with respect to a lower end of the upper end outer periphery, a downwardly facing concave groove formed inwardly with respect to the second portion, and at least one downward sloping portions extending downwardly and inwardly from an inner side of the concave groove, the at least one downward sloping portion joining the hull bottom.

11. A boat with sponson, comprising:

a hull sponson provided at an upper end outer periphery of a hull in order to attach a deck constituting an upper part of a boat body to the hull constituting a lower part of the boat body; and a deck sponson provided at an outer periphery of the deck, wherein the deck sponson is overlaid on the hull sponson and bonded, and wherein each of the hull sponson and deck sponson is formed with a substantially L-shaped cross-section, each including a horizontal sponson and a downwardly extending sponson, and wherein spray generated as a result of a front section of the boat body gliding and colliding with waves is prevented from splashing a deck side by making an extent of a projection of a member on the side of the front section of the boat body equal to amount (L1), and by making the extent of the projection of another member at left and right lateral side portions of the boat body equal to amount (L2), wherein the amount (L1) is substantially larger than the amount (L2) in order to reduce the spray at the front section of the boat body, and wherein the hull sponson joins the portion of the upper end outer periphery of the hull that extends substantially vertically downward, the hull sponson and the upper end outer periphery of the hull that extends substantially downward forming a downwardly facing concave space around the upper end outer periphery of the hull.

12. The boat with a sponson according to claim 11, wherein the hull sponson includes a spray receiving section formed along an upper end outer periphery of the boat body, and a spray returning section extending in a downward direction from an end of the spray receiving section.

13. The boat with a sponson according to claim 11, wherein the extent of the projection of the member gradually becoming smaller from a forward-most part of the front section where the extent is the amount (L1) to forward-most parts of left and right portions at a rear section of the boat body where the extent of the projection is the amount (L2), and with the extent of the projection at the left and the right portions at the rear section of the boat body being fixed at the amount (L2).

14. The boat with a sponson according to claim 11, wherein each of the hull sponson and the deck sponson is formed with a horizontal sponson and a downward extending section, and wherein at least at the front section of the boat body, width of the amount (L1) of the horizontal sponson of the hull sponson is larger than a height (H1) of a downwardly extending section of the hull sponson.

15. The boat with a sponson according to claim 11, wherein each of the hull sponson and the deck sponson is formed with a downwardly extending section, wherein a height (H1) of the downwardly extending sponson is constant around the upper end outer periphery of the hull.

16. The boat with a sponson according to claim 11, wherein the hull is formed with multiple distinct shapes between the hull sponson and a hull bottom, the multiple distinct shapes including:

the upper end outer periphery (a first portion) extending substantially vertically and downwardly from a inner edge of the hull sponson, a second portion extending substantially horizontally and inwardly with respect to a lower end of the upper end outer periphery, a downwardly facing concave groove formed inwardly with respect to the second portion, and at least one downward sloping portions extending downwardly and inwardly from an inner side of the concave groove, the at least one downward sloping portion joining the hull bottom.

17. A boat with a sponson, comprising:

a hull sponson provided at an upper end outer periphery of a hull in order to attach a deck constituting an upper part of a boat body to the hull constituting a lower part of the boat body; and a deck sponson provided at an outer periphery of the deck, wherein the deck sponson is overlaid on the hull sponson and bonded, and wherein each of the hull sponson and deck sponson is formed with a substantially L-shaped cross-section, each including a horizontal sponson and a downwardly extending sponson, and wherein spray generated as a result of a front section of the boat body gliding and colliding with waves is prevented from splashing a deck side by making an extent of a projection of a member on the side of the front section of the boat body equal to amount (L1), and by making the extent of the projection of another member at left and right lateral side portions of the boat body equal to amount (L2), wherein the amount (L1) is substantially larger than the amount (L2) in order to reduce the spray at the front section of the boat body, wherein each of the hull sponson and the deck sponson is formed with a downwardly extending section, and wherein a maximum height (H2) of the downwardly extending section at a front section of the hull sponson is larger than height (H1) of the downwardly extending section at left and right lateral side portions of the hull sponson disposed rearwardly of the front section of the hull sponson, the height (H) gradually becoming smaller in a rearward direction from the maximum height (H2) at the front section of the hull sponson so as to have the height (H1) at the left and right lateral side portions of the hull sponson.

18. A boat with a sponson, comprising:

a hull sponson provided at an outer periphery of a hull in order to attach a deck constituting an upper part of a boat body to the hull constituting a lower part of the boat body; and a deck sponson provided at an outer periphery of the deck, wherein the deck sponson is overlaid on the hull sponson and bonded, and wherein each of the hull sponson and deck sponson is formed with a substantially L-shaped cross-section, each including a horizontal sponson and a downwardly extending sponson, and wherein spray generated as a result of a front section of the boat body gliding and colliding with waves is prevented from splashing a deck side by making an extent of a projection of a member on the side of the front section of the boat body equal to amount (L1), and by making the extent of the projection of another member at left and right lateral side portions at a rear section of the boat body equal to amount (L2), wherein the amount (L1) is substantially larger than the amount (L2) in order to reduce spray at the front section of the boat body, wherein each of the hull sponson and the deck sponson is formed with a downwardly extending section, and wherein a maximum height (H2) of the downwardly extending section at a front section of the hull sponson is larger than height (H1) of the downwardly extending section at left and right lateral side portions of the hull sponson disposed rearwardly of the front section of the hull sponson, the height (H) gradually becoming smaller in a rearward direction from the maximum height (H2) at the front section of the hull sponson so as to have the height (H1) at the left and right lateral side portions of the hull sponson, and further comprising:

an upper end outer periphery of the hull extending substantially downwardly from an inner edge of a horizontal sponson, and a portion of the hull that is substantially horizontal and extends rearwardly from a lower end of the upper end outer periphery of the hull.

19. The boat with a sponson according to claim 18, wherein the hull sponson joins the portion of the upper end outer periphery of the hull that extends substantially vertically downward, the hull sponson and the upper end outer periphery of the hull that extends substantially downward forming a downwardly facing concave space around the upper end outer periphery of the hull.

* * * * *